US005149291A

United States Patent [19]

Di Franco et al.

[11] Patent Number: 5,149,291

[45] Date of Patent: Sep. 22, 1992

[54] MOVING TOYS FORMED FROM FLEXIBLE SHEET

[76] Inventors: Jack E. Di Franco, 1201 S. Ocean Dr., Apt. 1903 S., Hollywood, Fla. 33019; Alvin S. Blum, 2350 Del Mar Pl., Fort Lauderdale, Fla. 33301

[21] Appl. No.: 609,197

[22] Filed: Nov. 5, 1990

[51] Int. Cl.[5] ..... A63H 3/08

[52] U.S. Cl. ..... 446/488; 446/3; 446/385

[58] Field of Search ..... 446/3, 71, 72, 76, 80, 446/97, 289, 385, 387, 388, 487, 488

[56] References Cited

U.S. PATENT DOCUMENTS

| | | | |
|---|---|---|---|
| 585,092 | 6/1897 | Gibson | 446/388 |
| 853,730 | 5/1907 | Pearson et al. . | |
| 966,761 | 8/1910 | Noll . | |
| 1,705,863 | 3/1929 | Ikeda | 446/385 |
| 2,111,129 | 3/1938 | Rittenhouse | 446/488 X |
| 2,372,799 | 4/1945 | Smith | 446/72 |
| 2,618,888 | 11/1952 | Hoff | 46/45 |
| 2,811,809 | 11/1957 | Di Franco | 446/3 |
| 2,813,371 | 11/1957 | Tiebe | 446/3 |
| 4,387,530 | 6/1983 | Miller | 46/1 L |
| 4,925,429 | 5/1990 | Kaulfuss et al. | 446/488 X |

FOREIGN PATENT DOCUMENTS 853870 12/1952 Fed. Rep. of Germany .

*Primary Examiner*—Robert A. Hafer
*Assistant Examiner*—Sam Rimell
*Attorney, Agent, or Firm*—Alvin S. Blum

[57] ABSTRACT

A system for constructing a variety of moving toys from flexible sheet material uses the vibrations of a loudspeaker to move the toy. The toy is provided in the form of an elongate strip that is assembled into the complete toy by simply bending the strip along its long axis into a generally cylindrical shape and fastening together. The strip has a top portion defining one or more animate or inanimate objects, an intermediate portion for fastening the assembled toy together and a bottom portion with parallel ribbons or strips extending downward. When assembled into the cylindrical shape, the toy is self-supporting and rests upon the ribbons. When a box with an open side is applied with the open side against a loudspeaker, music will vibrate the top of the box. When the toy is on the box, it will move or dance to the music. When the ribbons extend downward at a slanting angle, the toy will rotate in one direction.

20 Claims, 2 Drawing Sheets

FIG. 1
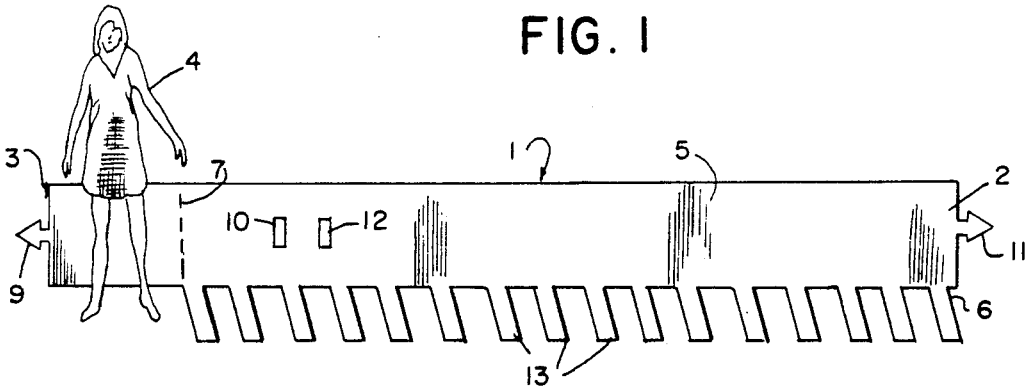
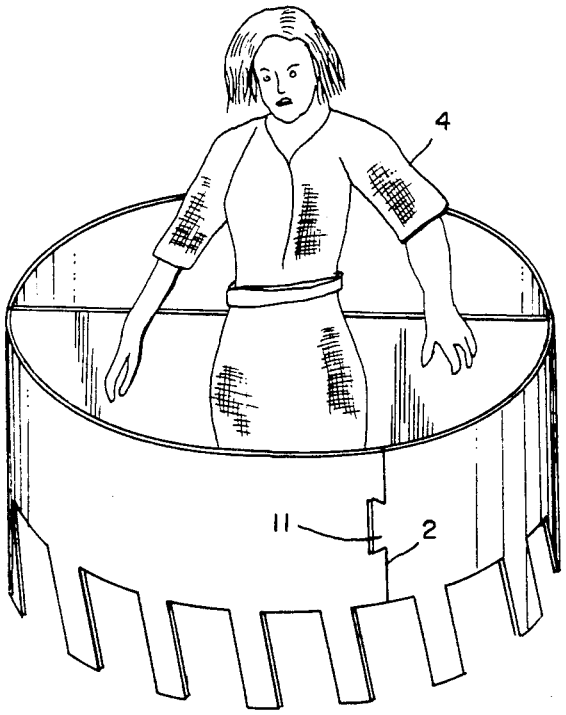
FIG. 2
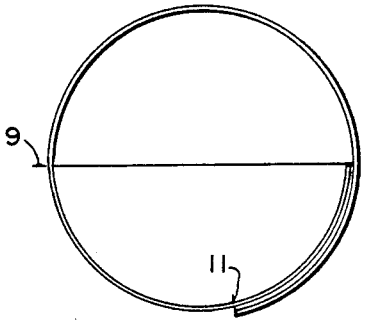
FIG. 3
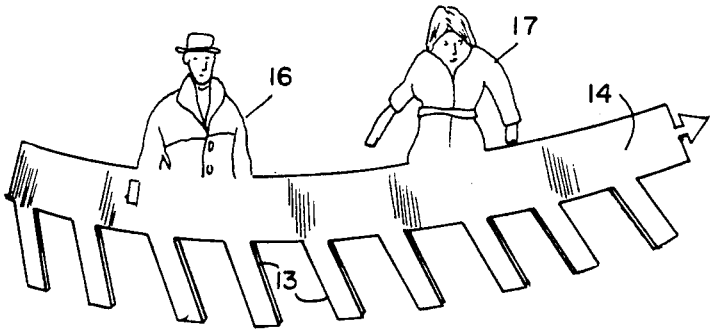
FIG. 4

MOVING TOYS FORMED FROM FLEXIBLE SHEET

BACKGROUND OF THE INVENTION

This invention relates to moving toys and more particularly to toys that move about a vibrating surface that are constructed from a flat flexible sheet of material.

U.S. Pat. No. 4,387,530 issued Jun. 14, 1983 to Miller teaches forming self-supporting toys from a single flexible sheet. They are an extension of children's dolls cut out of paper that have been well known for many years. These toys do not have an inexpensive means for moving about.

It is also well known that toys supported by flexible bristles will move on a vibrating surface, as exemplified by U.S. Pat. Nos. 853,730 issued May 14, 1907 to Pearson and 3,811,809 issued Nov. 5, 1957 to DiFranco. These toys are complex and expensive to make and require special packaging for storage and shipment.

SUMMARY OF THE INVENTION

It is accordingly an object of the invention to provide a system for constructing a variety of organic forms usable as toys, decorations and for educational purposes that will move on a vibrating surface such as a membrane driven by an audio speaker.

It is a further object of this invention to provide a self-supporting moving toy system that can be constructed from a single flexible sheet.

It is yet another object to provide such a system that may be stored and shipped economically as a flat sheet and easily assembled by a child into an operating toy.

The moving toy of the invention comprises a flat sheet of flexible material having a degree of stiffness with a top portion, a center portion and a bottom portion arranged to be rolled into a cylinder or cone and held together in cylindrical or conical shape by fastening means such as adhesive.

The bottom portion is cut into a series of downwardly directed strips. The center portion bears fastening means for holding the toy in a generally cylindrical form when the flat sheet is rolled into such a configuration for assembly into a self supporting structure in which the structure is supported by the downwardly directed strips. When the toy rests on a vibratory surface, the vibrations will cause the toy to move about on the flexible strips. By cutting the strips so that they all are directed down at a common slanting angle, the toy will have a generally circular motion in one direction.

The upper portion may be cut into a variety of shapes to represent a particular figure or figures such as the upper body of one or more dancers, animals, and the like. The sheet may be decorated with appropriate art work by painting, printing and the like. The lower strips may be decorated so as to represent a skirt, for example. The upper portion may be arranged to receive an object which is carried about by the dancing toy.

An effective means of animating the toy is to provide a box with a hollow side that is applied to the loudspeaker of an audio system. This causes the upper surface of the box to vibrate. The toy resting on the upper surface will dance in time to the music.

These and other objects, advantages and features of the invention will become more apparent when the detailed description is studied in conjunction with the drawings.

BRIEF DESCRIPTION OF THE DRAWINGS

FIG. 1 is a plan view of the device of the invention before assembly.

FIG. 2 is a perspective view of the assembled device of FIG. 1.

FIG. 3 is a top view of the device of FIG. 2.

FIG. 4 is a plan view of another embodiment of the device of the invention before assembly.

DETAILED DESCRIPTION OF PREFERRED EMBODIMENTS

Figure 8:
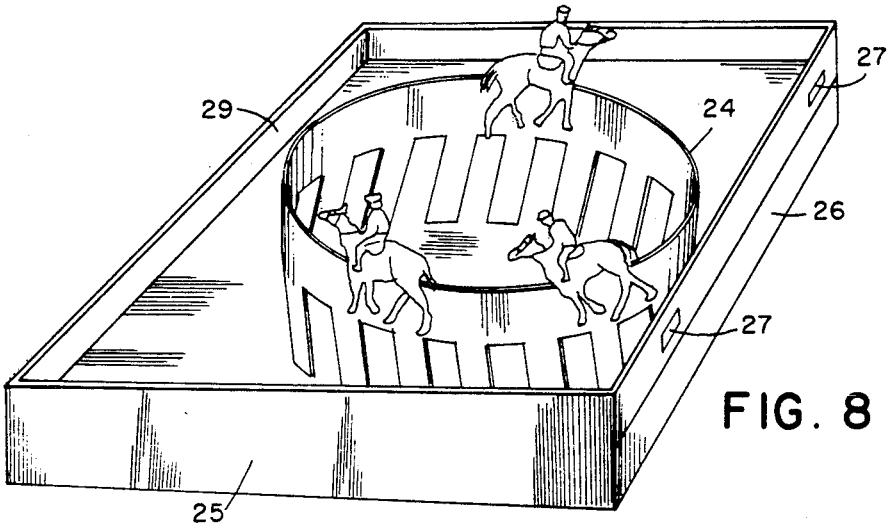
FIG. 8 is a perspective view of another embodiment of the device of the invention.

Referring now first to FIGS. 1–3, an elongate strip 1 of sheet material is cut in a particular shape with a long axis terminating in two short sides 2 and 3. The strip 1 has a top portion 4, an intermediate portion 5 and a bottom portion 6. The top portion 4 defines a shape representative of a particular object or objects that may be animate or inanimate and may be partially cut out or imprinted to define the objects. In this case the head and upper torso of a girl are shown. Intermediate portion 5 is provided with fastening means to fasten the flat device together after it is bent or folded into a generally cylindrical shape. The strip is first folded at right angles along folding line 7. Then the first short side 2 is brought around past second short side 3 until tab 9 can be snapped into aperture 10. The short side 2 is pulled further around into a cylinder shape until tab 11 extending from side 2 can be snapped into aperture 12 to hold the cylinder together in one self supporting structure. The bottom portion 6 of the strip is provided with a plurality of downwardly directed ribbons or strips 13 formed by cutting away the balance of the bottom portion. The finished cylinder now rests upon these ribbons. The intermediate portion 5 and bottom portion 6 may be decorated to represent a skirt around the lower body of the dancer with the girl positioned in the diameter of the cylinder. When this completed toy is resting upon a vibrating surface that vibrates from music the toy will move about or dance to the music.

Figure 5:
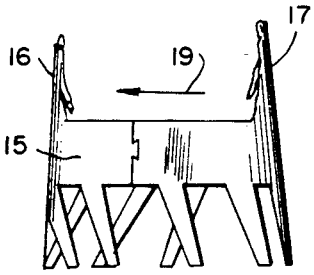
FIG. 5 is a side view of the assembled device of FIG. 4.

FIGS. 4 and 5 shows an alternative embodiment with an arcuate strip 14 that forms a section of a cone 15 when assembled. The two FIGS. 16, 17 form a dancing couple both on the circumference of the cone. The strips 13 are shown all extending downward at a common slanted angle. This will cause the assembled toy to rotate in one direction as indicated by arrow 19.

Figure 6:
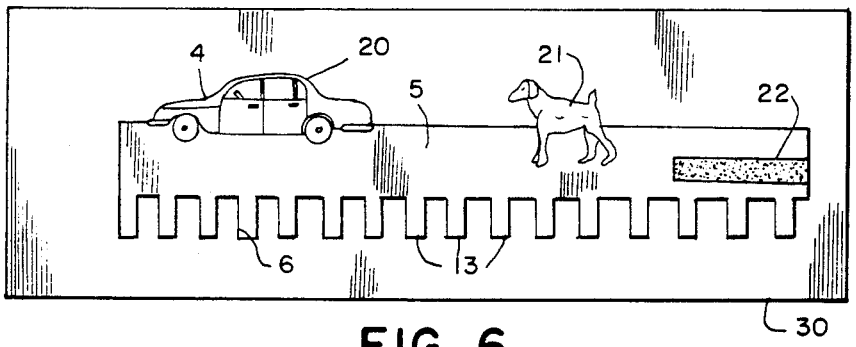
FIG. 6 is a plan view of another embodiment of the device of the invention before assembly.

FIG. 6 shows a dog 21 chasing an automobile 20. An adhesive strip 22 is shown for fastening the toy together.

Figure 7:
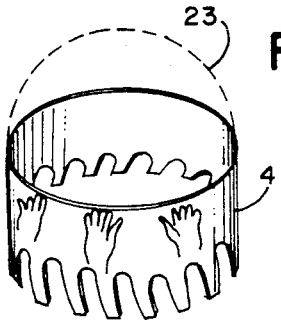
FIG. 7 is a perspective view of another embodiment of the device of the invention.

FIG. 7 shows an embodiment in which the top portion is arranged to receive an object such as a ball 23 (shown in phantom) or any light object the child might wish to try.

FIG. 8 is configured to represent a merry-go-round 24. A box 25 has an open side 26 and fasteners 27 such as adhesive or hook and loop fasteners for removably attaching to a loudspeaker of a radio or the like (not shown). A fence 29 retains the toy.

As shown in FIG. 6, the system may be provided in the form of a rectangular sheet of material 30 marked for cutting by the user to the appropriate shape for use. The sheet material may be plastic, thin metal, paper, coated paper and the like.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

We claim:

1. A moving toy constructed from a sheet of material comprising:

an elongate strip of sheet material having a long axis, two short sides, and having a top portion, an intermediate portion and a bottom portion extending along said long axis;

said top portion defining at least one object extending upward from said intermediate portion;

said bottom portion provided with a plurality of downwardly directed appendages, said appendages each having a first end connected to said intermediate portion and a second, free end upon which said toy stands; and said toy being assembled by bending said strip along said long axis into a generally cylindrical shape wherein a first said short side overlaps a second said short side and said cylindrical shape being maintained by fastening means, said fastening means being located at at least one of said short sides of said intermediate portion, said intermediate portion thereby forming a substantially smooth, continuously curved, outer wall, wherein said toy will move about on a vibratory surface.

2. The toy according to claim 1, in which said appendages extend downward at a substantially common slanting angle in a first direction, wherein said toy will rotate in a second direction when resting on said vibratory surface.

3. The toy according to claim 1, including a chamber having an upper surface and at least one open wall adapted for applying to a sound generating apparatus, in which said upper surface operates as said vibratory surface, said upper surface being provided with a fence means for retaining said toy upon said upper surface.

4. The toy according to claim 1, in which said fastening means includes tab means for engaging said intermediate portion.

5. The toy according to claim 1, in which said fastening means includes adhesive.

6. The toy according to claim 1, in which said sheet material is paper.

7. The toy according to claim 1, in which said sheet material is metal.

8. The toy according to claim 1, in which said sheet material is plastic.

9. The toy according to claim 1, in which said object is a representation of an animate object.

10. The toy according to claim 1, in which said object is a representation of an inanimate object.

11. The toy according to claim 1, in which said toy represents a merry-go-round.

12. A system for constructing a moving toy from a sheet of material comprising:

an elongate strip of sheet material having a long axis, two short sides, and having a top portion, an intermediate portion and a bottom extending along said long axis;

said top portion extending upward from said intermediate portion;

said bottom portion defining a plurality of downwardly directed appendages, said appendages each having a first end connected to said intermediate portion and a second, free end upon which said toy stands;

said toy constructed for assembling by bending said strip along said long axis into a generally cylindrical shape wherein a first said short side overlaps a second said short side and said cylindrical shape is maintained by fastening means, said intermediate portion thereby forming a substantially smooth, endless, continuously curved outer wall, wherein said toy will move about on a vibratory surface.

13. The system according to claim 12, in which said top portion is adapted for receiving a light weight object to be moved about.

14. The system according to claim 12, in which said appendages extend downward at a substantially common angle to said long axis in a first direction, wherein said toy will rotate in a second direction when resting on said vibratory surface.

15. The system according to claim 12, including a chamber having an upper surface and at least one open wall adapted for applying to a sound generating apparatus, in which said upper surface operates as said vibratory surface, said upper surface being provided with a fence means for retaining said toy upon said upper surface.

16. The system according to claim 12, in which said generally cylindrical shape has a smaller diameter at said top portion than at said bottom portion.

17. A method for constructing a moving toy from a sheet of material comprising the steps of:

providing an elongate strip of thin sheet material having a long axis, two short sides, and having a top portion, an intermediate portion and a bottom portion extending along said long axis, said top portion extending upward from said intermediate portion, said bottom portion having a plurality of downward directed appendages, said appendages each having a first end connected to said intermediate portion and a second, free end upon which said toy stands, said appendages being substantially parallel to one another;

assembling said toy into a cylindrical shape by bending said strip along said long axis until a first said short side overlaps a second said short side; and maintaining the shape so formed by fastening means located at at least one of said short sides of said intermediate portion, wherein said toy will move about on the free ends of said appendages on a vibratory surface.

18. The method according to claim 17, in which said top portion defines a representation of at least one object extending upward from said intermediate portion.

19. The method according to claim 18, in which said appendages extend downward at a substantially common slanting angle in a first direction, whereby said toy will rotate in a second, opposite direction when resting on said vibratory surface.

20. The method according to claim 19, in which said fastening means is selected from the group of fastening means consisting of adhesive means and interlocking tab means.

* * * * *